United States Patent [19]

Balz

[11] 4,257,198

[45] Mar. 24, 1981

[54] FINISHING MACHINE AND PROCESS

[75] Inventor: Gunther W. Balz, Kalamazoo, Mich.

[73] Assignee: Roto-Finish Company, Inc., Kalamazoo, Mich.

[21] Appl. No.: 25,386

[22] Filed: Mar. 30, 1979

Related U.S. Application Data

[62] Division of Ser. No. 833,583, Sep. 15, 1977, Pat. No. 4,172,339.

[51] Int. Cl.[3] ..... B24B 1/00

[52] U.S. Cl. ..... 51/313

[58] Field of Search ..... 51/164.1, 164.2, 163, 51/313-316; 366/198, 217, 208, 209, 216; 233/25

[56] References Cited

U.S. PATENT DOCUMENTS

| | | | |
|---|---|---|---|
| 2,609,617 | 9/1952 | Hall | 34/58 |
| 2,923,104 | 2/1960 | Olson | 51/164.1 |
| 3,553,897 | 1/1971 | Bobkowski | 51/164.1 |
| 3,816,999 | 6/1974 | Dreher | 51/164.1 |
| 4,041,648 | 8/1977 | Heiberger | 51/164.1 |
| 4,104,831 | 8/1978 | Kobushiki | 233/25 |

*Primary Examiner*—Harold D. Whitehead

*Attorney, Agent, or Firm*—Gordon W. Hueschen

[57] ABSTRACT

A gyratory finishing machine, of the type in which the finishing units gyrate about a common center and advantageously rotate about their own axis, is provided with loading and unloading means for loading and unloading selected finishing chambers without stopping the gyration of the other finishing chambers. This is generally accomplished through a null-point producing means for establishing a null-point relation between the selected finishing chamber and the loading and unloading means. The null-point can be established by bringing the selected finishing chamber to said common center, or by causing said loading and unloading means to gyrate in unison with the gyration of the selected finishing chamber. The loading and unloading can be effected while the selected finishing chamber is at the common center or by transferring the selected finishing chamber from the null-point to a remote loading station.

19 Claims, 17 Drawing Figures

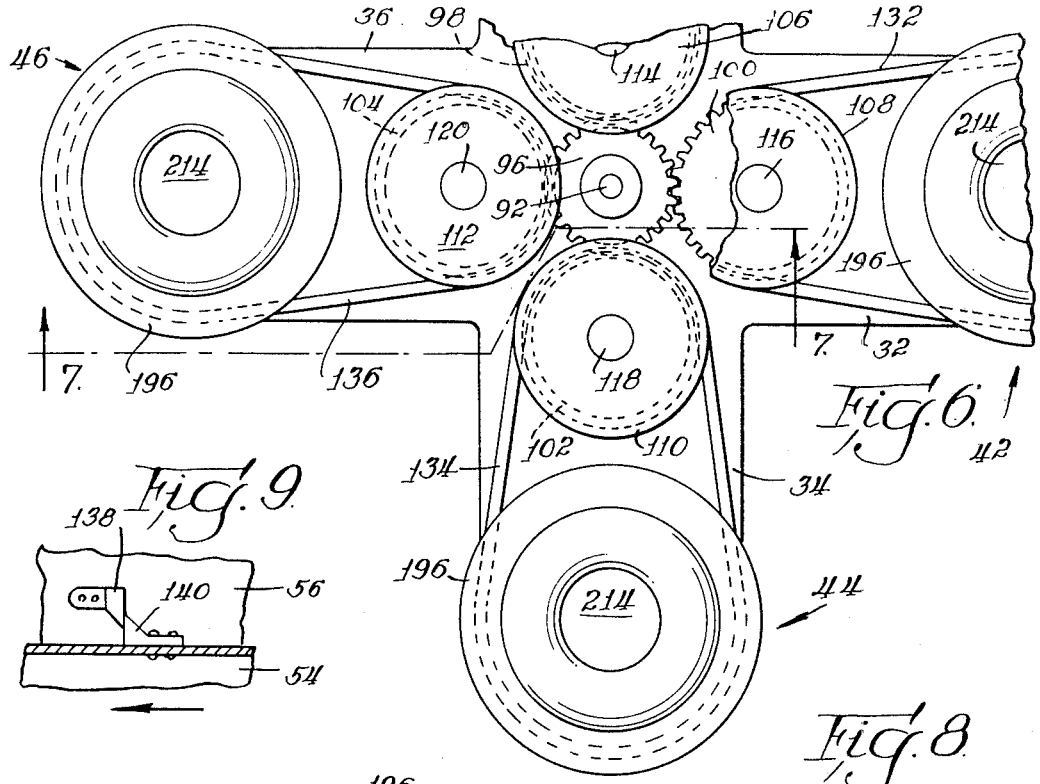
Fig. 6
Fig. 9
Fig. 8
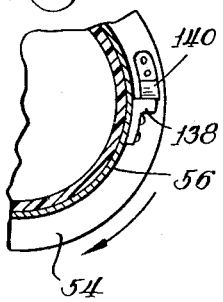
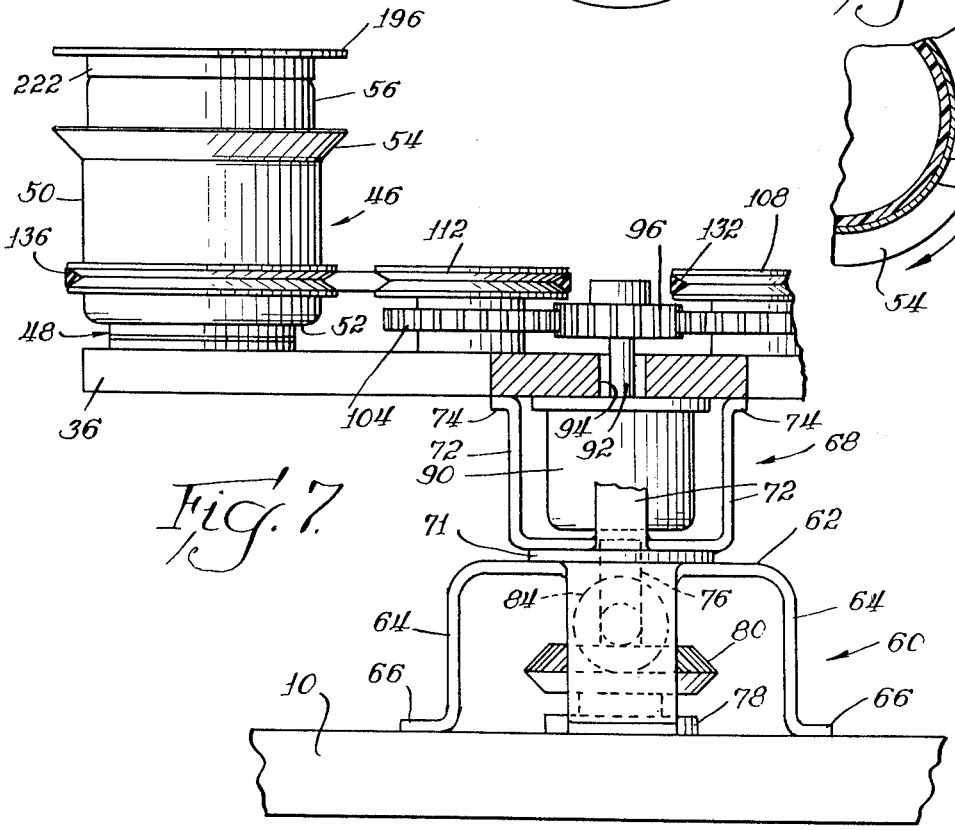
Fig. 7

FINISHING MACHINE AND PROCESS

This is a Division of application Ser. No. 833,583, filed Sept. 15, 1977, now U.S. Pat. No. 4,172,339, issued Oct. 30, 1979.

FIELD OF INVENTION AND PRIOR ART

This invention relates to a finishing machine and process in which a plurality of finishing units are mounted for gyratory motion in a common plane about a common center.

Finishing machines of this class are known in the art, but all have the disadvantage that, in order to remove a work piece, to add a new work piece, or to change the finishing material in any selected finishing unit, the whole machine must be shut down. An example is seen in German Auslegeschrift No. 23 07 950 and the following U.S. Pat. Nos. 1,491,601; 1,570,242; 2,387,095; 2,476,078; and, 2,561,037.

OBJECTS OF THE INVENTION

It is an object of the invention to provide an improved gyratory finishing machine and process. It is a further object of the invention to provide a gyratory finishing machine and process in which changes can be made in selected finishing units as to the work piece or the finishing material, or both, without having to shut down the machine or interrupt the process going on in the other finishing units. It is a further object of the invention to provide simple and effective means for bringing a selected finishing unit into a null-point relationship with means for removing a finishing chamber to a work station where the removed finishing chamber can be reloaded. It is a further object of the invention to provide a gyratory finishing machine and process in which the finishing units gyrate in different orbits and selected finishing units can be shifted from one orbit to another. It is a further object of the invention to provide simple and effective means for the gyrating finishing unit to rotate about its own axis. It is a further object of the invention to avoid the disadvantages of the prior art and to obtain such advantages as will appear as the description proceeds.

BRIEF DESCRIPTION OF THE INVENTION

The invention relates to a gyratory finishing machine and process of the type in which a plurality of finishing units are mounted for gyratory motion in a common gyratory plane about a common center and is particularly directed to a combination therewith of loading and unloading means for loading and unloading selected finishing chambers without stopping the gyration of other finishing chambers.

In accordance with one form of the invention, a null-point producing means is provided for bringing the selected finishing chamber to the common center. At this point, the loading and unloading means is actuated so that the finishing chamber is loaded and unloaded while at the common center or is carried to a remote loading station where it is unloaded, and another finishing chamber, or the same finishing chamber which has been reloaded, is carried back to the null-point. The finishing unit, at the null-point, with its reloaded finishing chamber is then moved back into a gyratory orbit and another selected finishing chamber moved into null-point relation, with the operation above-described repeated as often as desired, to recharge a selected finishing chamber with a new work piece, a different finishing material, or both, or even just to inspect the finishing chamber to see how far the finishing operation has progressed.

Advantageously, when the selected finishing chamber is carried from the null-point to a remote loading station, there is provided holding means for releasably holding the finishing chamber, grasping means for grasping a finishing chamber for the purpose of removing it from or inserting it into its holding means, removing and inserting means acting through the grasping means for removing and inserting a selected finishing chamber from or into the holding means, which grasping means and removing and inserting means are operative when the selected finishing chamber and the grasping means are in the null-point relation, and carrying means for carrying the grasped and removed selected finishing chamber to the remote loading station.

In accordance with another form of the invention, a null-point producing means is provided for causing the loading and unloading means to gyrate in unison with a gyrating selected chamber. In this case, there also will be provided holding means, grasping means, inserting and removing means, and carrying means. When this null-point relation is established, the grasping means is actuated to grasp the selected chamber, and the removing and inserting means is actuated to remove the grasped selected chamber from its holding means. The grasping means and the removing and inserting means, together with the grasped and removed selected chamber, is then carried to a remote work station where the selected chamber is recharged or replaced by another finishing chamber, which is then returned to the empty holding means in the reverse manner that the selected finishing chamber was removed therefrom, that is, by causing the grasping means and the removing and inserting means, together with the grasped finishing chamber to gyrate in unison with the gyrating empty holding means, actuating the removing and inserting means to insert the finishing chamber into the empty holding means, actuating the grasping means to release the grasped finishing chamber, and then causing the grasping means and the removing and inserting means to gyrate in unison with another selected chamber, and then repeating the operation as often as desired, to remove selected finishing chambers from a gyrating holding means to a remote work station.

The gyratory plane can be horizontal or vertical, or intermediate thereof.

When the loading is effected while the selected finishing chamber is at the common center null-point, the contents can be removed by suction or magnetic means and can be loaded with any suitable device for carrying the finishing material and the work piece into the chamber and depositing it there. Advantageously, particularly when the gyratory plane is horizontal or nearly so, the loading can be effected directly into the open top of the finishing chamber and the unloading can be effected through a trap door in the bottom. In the latter case, it is advantageous to have the bottom of the finishing chamber in the shape of an inverted truncated cone and the trap door arranged to seat in the bottom of this inverted truncated cone. Advantageously, the trap door moves axially upward to open position and axially downward to closed position, thereby providing an annular opening through which the finishing material and work piece slide down the sides of the inverted truncated cone into a suitable receiver. If desired, the trap door can be mounted so that it is activated when the selected finishing chamber is moved to the center null-point position. It is of advantage, also, to have the trap door taper upwardly and inwardly to promote movement of the finishing material and work piece into the annular opening when the trap door is in open position. Advantageously, this upward and inward taper is the result of said trap door being cone shaped. It will always be understood that it can be dome shaped or that it can curve inwardly and upwardly to a point.

Advantageously, the finishing units comprise a cup-shaped holding means and a barrel-shaped finishing chamber complementary to the cup-shaped holding means, mounted with the axis of the holding means normal or perpendicular to the the gyratory plane either horizontal or at an angle to the horizontal, such that the barrel-shaped finishing chambers are held in the cup-shaped holding means by gravity. Advantageously, the angle to the horizontal is zero, but if desired, it may range up to about 60 degrees, or so.

Also, it is of advantage to have each individual finishing unit rotate about its axis. Thus, the work piece and the finishing material in each individual finishing unit will be subjected to a rotary motion impressed upon a gyratory motion, so that effective contact between the finishing material and all parts of the work piece is accomplished.

It is of advantage, also, to provide each finishing chamber with a peripherally-disposed, complementary grasping means adapted to be grasped by the grasping means, which complementary grasping means can engage the complementary grasping means, even if said selected chamber is rotating when the engagement is made.

In a preferred form of the invention, the gyratory means comprises a finishing unit-supporting means on which the finishing units are supported in one or the other of different orbits. In a preferred form of the invention, means is provided for shifting selected finishing chambers from one orbit to another orbit. Advantageously, a selected finishing chamber in the outermost orbit is moved to the next adjacent orbit, and so on, until it is finally moved into the common center, where the desired null-point is established. The selected finishing chambers may then be removed from the null-point and replaced by a recharged finishing chamber and the recharged finishing chamber then moved in succession from one orbit to the next, until the outermost orbit is reached. The cycle is repeated.

In a preferred form of the invention, the finishing unit-supporting means comprises a rotatable supporting means mounted for rotation about a second common center in a plane parallel to the gyratory plane. The spacing between the axes of said finishing units and the second common center is the same as the spacing between the latter and said first common center, so that on rotation of the rotatable supporting means, the finishing units successfully pass through a null-point as they pass over the first common center. Advantageously, indexing means is provided for advancing the rotatable supporting means in a step-wise manner, so that said finishing units are brought in succession to the null-point and held there a time determined by the indexing interval.

In accordance with a preferred form of the invention, the rotatable supporting means comprises a first spider having four arms projecting from a central hub at a second common center with the arms oriented 90 degrees apart and having a holding means mounted on the end of each arm, a second spider constructed as the first spider, but with its central hub at a third common center, which is 180 degrees displaced from the second common center, that is, diametrically across the first common center. The first and second spiders are linked for rotation together with the arms of one spider displaced 45 degrees from the arms of the other spider, so that when a finishing unit of one spider is at the null-point, a further rotation of 45 degrees will bring a finishing chamber on the other spider to the null-point.

In accordance, with a preferred form of the invention, the carrying means comprises a movable bridge support movable to carry the grasping means and the removing and inserting means from a position over a loading station to a position over the null-point, and vice versa, with the grasping means being mounted in said bridge support for axial motion relative to a finishing chamber in a holding means at the null-point or at the loading station. Advantageously, the removing and inserting means comprises reciprocating means for moving the finishing chamber which has been grasped by the grasping means into and out of the holding means which is at the null-point, or for picking up or depositing a finishing chamber at the loading station. The reciprocating means has a reach sufficient to lift the finishing chamber to a position completely above the holding means, so that the lifted finishing chamber can be carried to the loading station, and returned, on movement of the bridge support.

Advantageously, the movable bridge support comprises an arm pivotally mounted at its center and having the reciprocating means mounted one on each opposite end thereof, with the distance between the pivot point of the arm and the reciprocating means mounted thereon being the same as the distance between the pivot point of the arm and the axes of the holding means at said null-point.

BRIEF DESCRIPTION OF THE DRAWINGS:

In the drawings:

FIG. 6 is a detail view of FIG. 1.

FIG. 7 is a partial section taken along line 7—7 of FIG. 6.

FIG. 8 is a partial section taken along line 8—8 of FIG. 5.

FIG. 9 is a partial section taken along line 9—9 of FIG. 5.

DETAILED DESCRIPTION OF THE INVENTION

Figure 1:
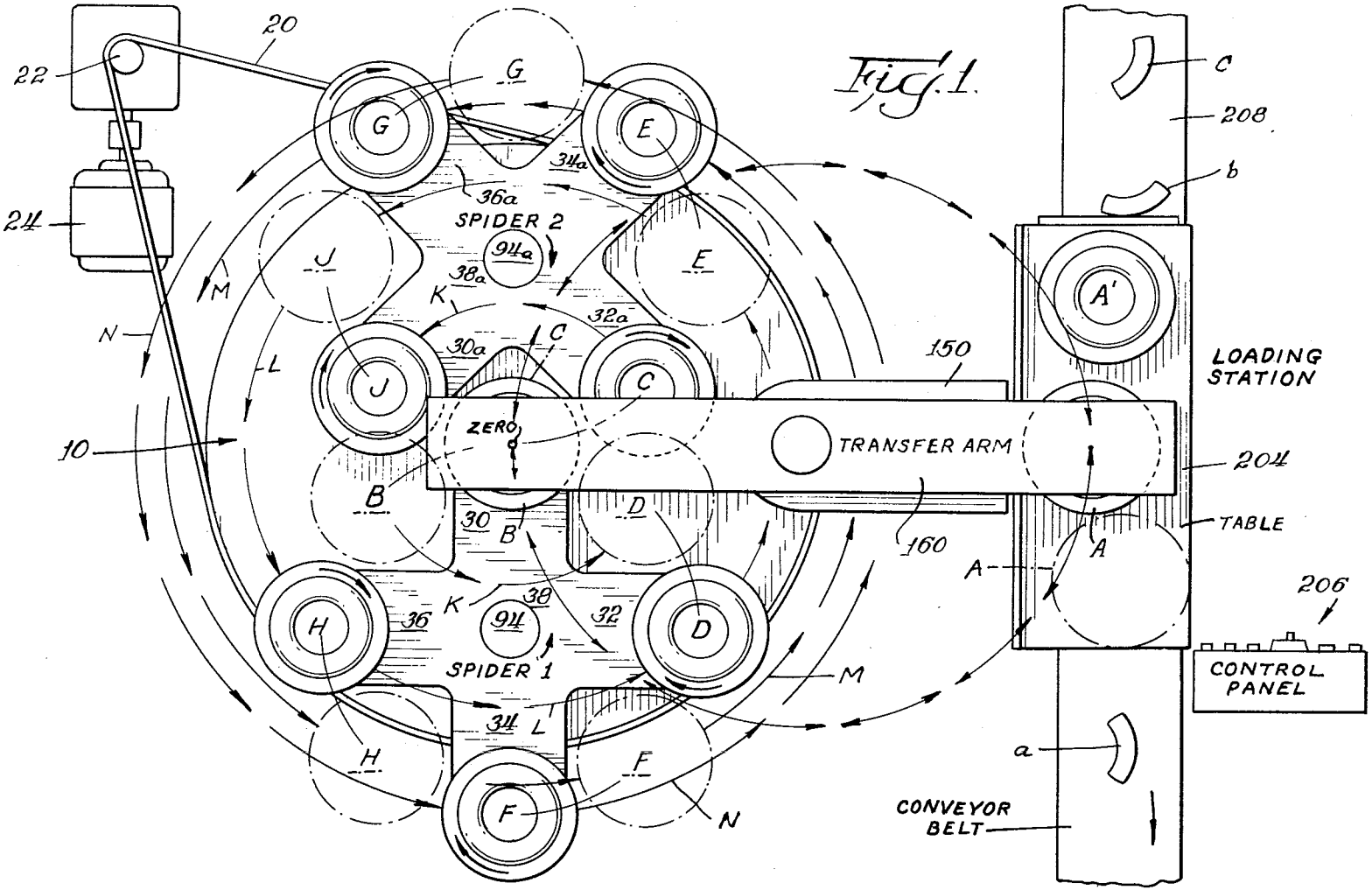
FIG. 1 is a plan view of one form of the invention.

Referring now particularly to FIGS. 1 through 9, there is illustrated a gyratory finishing machine according to the invention in which 10 represents a rotatable base support which is circular in top plan view, which is mounted on a spring-cushioned base 12 supported on a fixed base 14 by cushioning springs 16. Between the spring-cushioned base 12 and the rotatable base support 10 is an annular bearing race 18 which permits the rotatable base support 10 to rotate freely on the spring cushion base 12.

A belt 20 connects the periphery of the rotatable base support 10 with a pulley 22 which is driven by the prime mover 24. The prime mover is pivotally mounted at 26 and is spring-cushioned at 28 to accommodate any rocking of the rotary base support to the cushioning springs 16.

Figure 2:
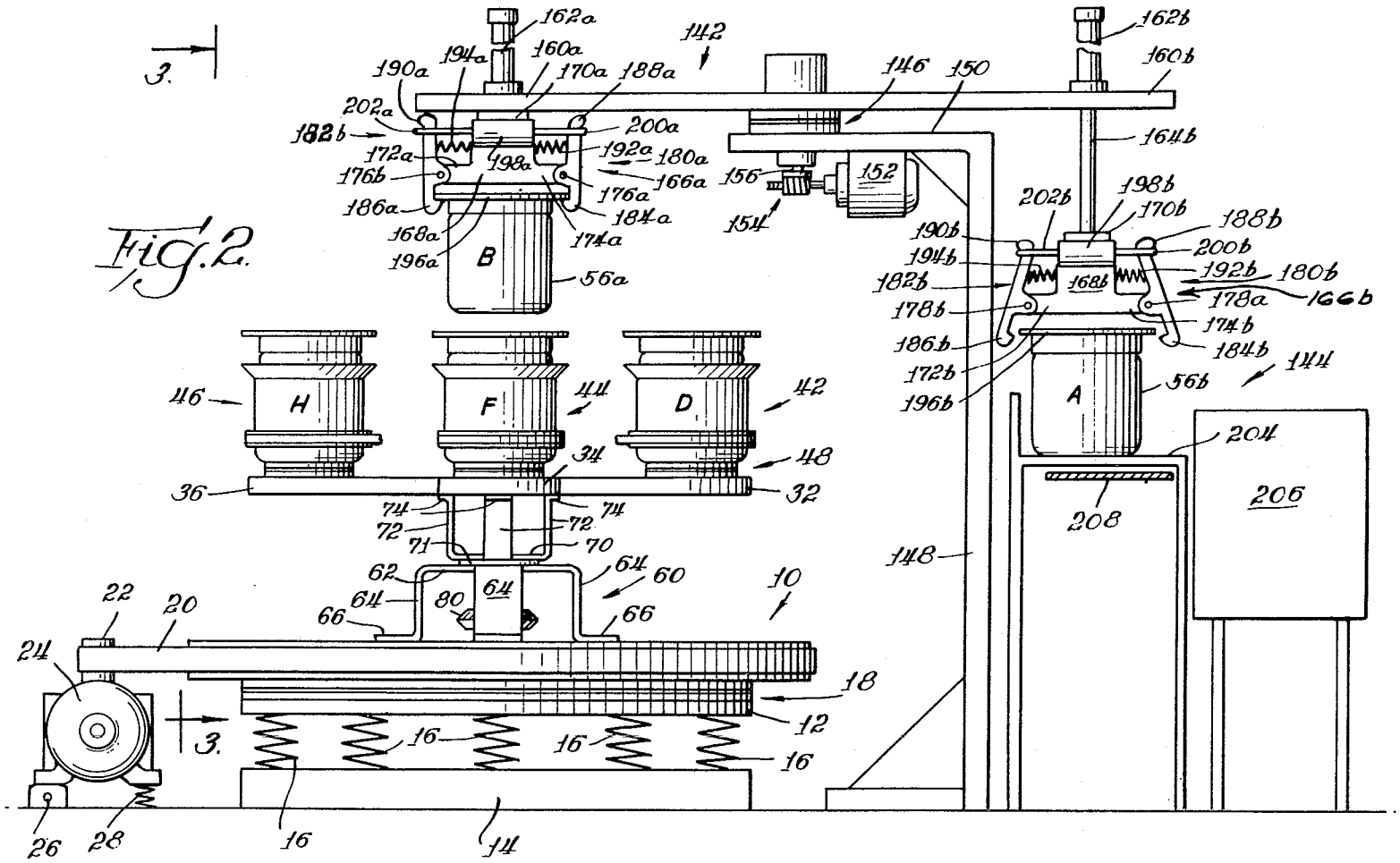
FIG. 2 is a side elevation of FIG. 1.

In the form of the invention shown in FIG. 2, the rotatable base support 10 has a flat upper surface and is mounted to rotate in a horizontal plane. It is to be understood, however, that it can be mounted to rotate in a plane at an angle to the horizontal, ranging from zero degrees to 90 degrees, though, with the particular design of the finishing chambers of this particular modification, it is desirable that the angle not exceed about 60 degrees and, preferably, that it is substantially zero.

Mounted on the rotatable base support 10 are two spiders, spider 1 and spider 2. Each spider has four arms, 30, 32, 34, 36, and 30*a*, 32*a*, 34*a*, and 36*a*, projecting at right angles, that is, 90 degrees apart, from a central hub 38 and 38*a*.

Mounted on the end of each arm of the spiders 1 and 2 is a cup-shaped holder mounted on a flat bearing race 48 for rotation about an axis which is normal to the spider, which in turn is parallel to the rotary base support 10. The cup-shaped holders are designated herein by 40, 42, 44, 46, and 40*a*, 42*a*, 44*a*, and 46*a*, corresponding, respectively, to the arms 30, 32, 34, 36, and 30*a*, 32*a*, 34*a*, and 36*a* on which they are supported. The description will be continued with reference to the cup-shaped holder 46, as best seen in FIGS. 2 and 7, unless otherwise indicated, it being understood that the construction and mounting of all the cup-shaped holders is the same as that which will be described for the cup-shaped holder 46.

The cup-shaped holder 46 has a cylindrical side wall 50 and a flat bottom 52, which rests on and is fastened to the top face of the bearing race 48, the bottom face of which rests on and is fastened to the arm 36 of spider 1. It will be understood that the bearing race 48 is so constructed to permit rotation of the top face with reference to the bottom face, but not to permit separation of the two faces, so that the cup-shaped holder 46 is free to rotate with respect to the arm 36, but yet is securely fastened thereto.

The upper edge of the cup-shaped holder 46 flares outwardly as shown at 54, at an angle of about 45 degrees, more or less, to permit facile insertion of a finishing chamber bottom 56. The height of the side wall 50, including the flared-out portion 54, is at least half and, preferably, three-fourths of the height of the finishing chamber 56, but is spaced from the top of the finishing chamber 56 for a purpose which will presently be described.

The spiders 1 and 2 are supported by supports 58 and 58*a*, the construction of which will be described with reference to support 58, as shown in FIG. 7, with the understanding that support 58*a* is a precise duplication of support 58.

Support 58 comprises a base support 60 and a flat upper surface 62 and supporting legs 64 at spaced intervals about the flared upper surface 62 and extending therefrom to feet 66, which are fastened to the rotatable base support 10.

The upper half of the spider support 58 is the top support 68, which has essentially the same basic construction as the base support 60, but is inverted. It has a flat bottom 70 with upstanding legs 72 about the periphery thereof, which extend from the flat bottom 70 to legs 74, which are affixed to the spider 1. The bottom 70 rests on a frictionless washer 71 which may be composed of nylon, Teflon TM, oil-impregnated sintered metal, or the like. Extending upwardly through a hole in the center of the flat top 62 is a shaft 76 which is affixed to the center of the flat bottom 70 of the top support 68 so that, when the shaft 76 rotates, the top support 68 rotates, and spider 1 rotates. The shaft 76 is journaled in bearing 78 affixed to the rotating base by shaft 82 through the complementary beveled gear 84.

The shaft 82 is driven by a Servo motor 86 through the worm gear drive 88.

The Servo motor 86 has a built-in indexing circuit timed to drive the spiders through a 45 degree arc at a time, for a purpose which will be described.

Disposed within the top support 68 and fastened to the spider is a motor 90, the drive shaft 92 of which extends up through a hole 94 in the spider and is affixed to a driving gear 96, which meshes with driven gears 98, 100, 102, and 104.

Integral or unitary with the driven gears are sheaves 106, 108, 110, and 112. The sheaves and driven gears are mounted for rotation about trunnion 114, 116, 118, and 120 which are affixed to the spider. Each of the cup-shaped holders 40, 42, 44, and 46 is provided with an annular sheave 122, 124, 126, and 128, which is affixed, respectively, to the cylindrical side walls of the cup-shaped holders and aligned, respectively, with the sheaves 106, 108, 110, and 112. The aligned sheaves are connected by belts 130, 132, 134, and 136. Thus, when the motor 90 is actuated, the cup-shaped holders 40, 42, 44, and 46 will be caused to rotate about their axes. At the same time, when prime mover 24 is actuated, the rotatable base support will be caused to rotate about its common center, so that the cup-shaped holders and the finishing chambers therein will be caused to gyrate about the common center and, at the same time, to rotate about their axes.

Figure 5:
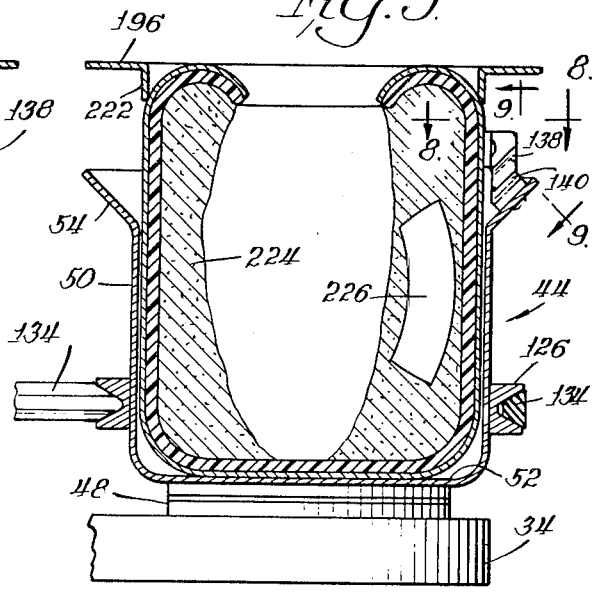
FIG. 5 is a cross-section of a finishing unit in operation.

While the friction between the finishing chamber and the cup-shaped holders will ordinarily be sufficient to transfer rotation of the cup-shaped holders to the finishing chambers, it is sometimes desirable to provide complementary detents 138 and 140 mounted, respectively, on the outer wall of the finishing chamber and the inner wall of the outlying portion of the cup-shaped holder, as best seen in FIGS. 5, 8, and 9. On rotation of the cup-shaped holders, the complementary detent 140 engages the complementary detent 138, and thus imparts positive rotation of the finishing chamber along with the rotation of the cup-shaped holder.

Now, as best seen in FIG. 1, the arms of the spiders are of such length that the axes of the cup-shaped holders pass over the common center, shown in FIG. 1, at zero. Also, spider 2 is displaced, with reference to spider 1, by 45 degrees, so that when spider 1 is in position where finishing unit B is at the zero or null-point, finishing unit C will be 45 degrees away. Then when the Servo motor 86 is activated to 45 degrees by the indexing circuit, finishing unit B will have rotated 45 degrees, shown in broken line, and finishing unit C will have moved into the zero or null-point position.

Figure 3:
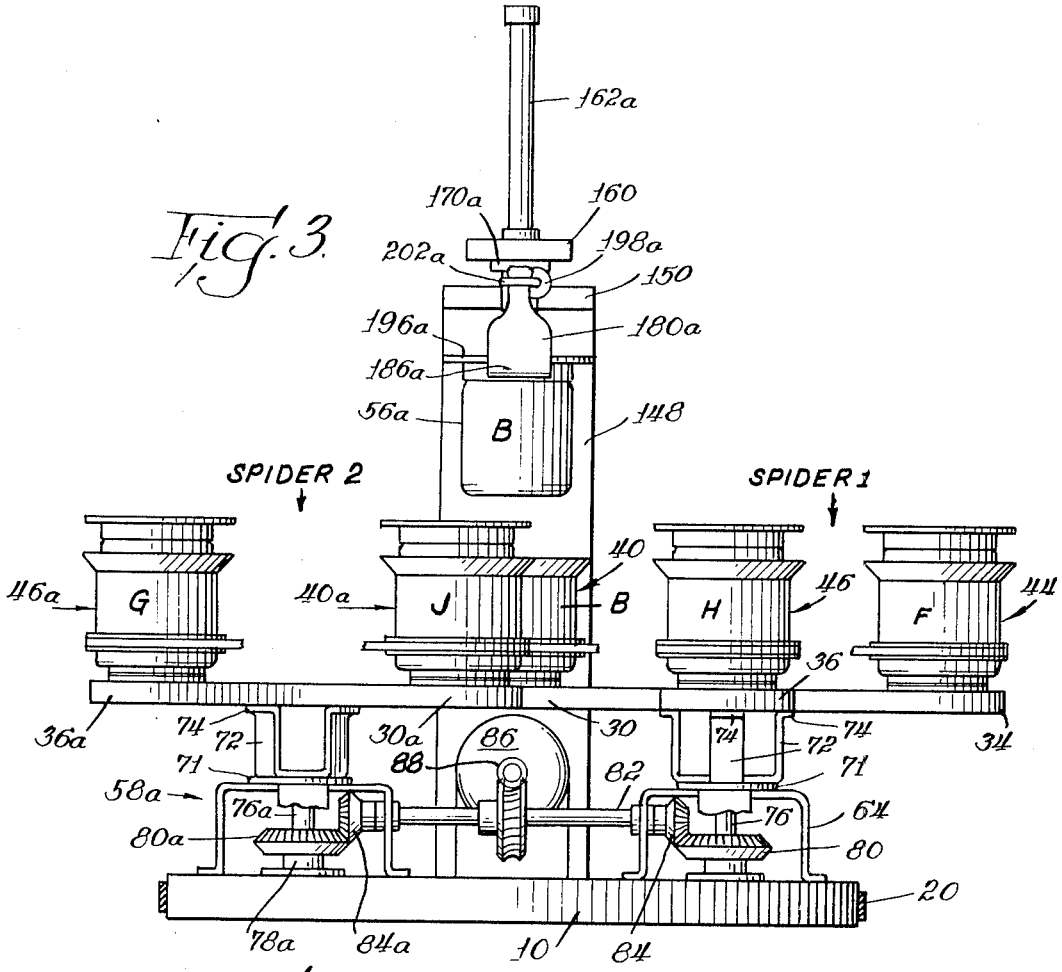
FIG. 3 is an end view taken along line 3—3 of FIG. 2.

As best shown in FIGS. 1, 2, and 3, means is provided for grasping a finishing chamber stationed at the zero or null-point, lifting it out of the cup-shaped holder and transferring it to a loading station and for picking up a newly charged finishing chamber, which may be the same or different from that removed, and returning it to the empty cup-shaped holder at the zero or null-point. This means comprises a bridge support 142, which spans the zero or null-point and the loading station 144. The bridge support 142 is pivotally mounted at its center 156 on the flat bearing 146, which is supported by a support 148, having a flat horizontal top surface 150. A Servo motor 152 acting through worm gear drive 154 acts to rotate the bridge support 142 through 180 degrees at a time.

The worm gear drive 154 drives shaft 156 which extends upwardly through the flat top 150 of support 148 through the flat bearing 146 and is affixed to the cap 158 which is affixed to the transverse arm 160 of bridge support 142.

At each end, **160*a* and 160*b*, of the arm 160, there is a hydraulic cylinder 162, the piston 164 of which is attached to the grasping means 166**.

The grasping means 166 comprises a yoke 168 having its base 170 affixed to the piston 164 and its arms 172 and 174 pivoted, respectively, at 176 and 178, to hooks 180 and 182.

The hooks 180 and 182 comprise a hook end 184 and 186 and a lever end 188 and 190, diametrically apposed across the pivots 176 and 178, so that movement of the lever ends in one direction causes the hook ends to move in the other direction. The lever ends are biased by biasing springs 192 and 194 away from the base of the yoke 170, to the position shown in the "a" series of the numbers, where the hook ends 184 and 186 engage the complementary grasping means or rim 196 at the top of the finishing chamber 56. The hook ends 184 and 186 have sloping interior surfaces, so that when the piston 164 is extended and the hook ends 184 and 186 reach the complementary grasping ring 196, the hook ends will automatically slide over the grasping ring 196 and become engaged.

Fastened to the base 170 of the yoke is a dual-action hydraulic cylinder 198. The pistons 200 and 202 are attached to the lever ends 188 and 190 of the hooks 180 and 182 and, when the hydraulic cylinder 198 is actuated, the pistons 200 and 202 are drawn in, so that the hooks 180 and 182 assume the position shown in the "b" series and in which the complementary grasping ring 196 is dis-engaged.

The loading station comprises a work table 204, a control panel 206, and a conveyor belt 208. The conveyor belt brings unfinished work pieces "b" and "c" to the work table and takes away finished work piece "a".

In operation, a finishing chamber A is deposited on the work table and released as shown in FIG. 2. It is then moved to a position shown in broken lines, where it is unloaded and the work piece "a" deposited on the conveyor belt. Another or the same finishing chamber A′ is then loaded with work piece "b", with or without new or additional finishing material, moved under the end **160*b*, where it is grasped by the grasping means 166*b*, and lifted off the work table. In the interim, the finishing unit comprising finishing chamber B will have been moved to the zero or null-point, as shown in FIG. 1, will have been grasped by the grasping means 166*a*, and lifted out of the cup-shaped holder to the position shown in FIG. 2 in the "a" series. The control panel will then actuate the Servo motor 152 which will cause the arm 160 to rotate through 180 degrees, so that the A′ finishing chamber will be in position in the zero or null-point, and the B finishing chamber over the loading station. The hydraulic cylinders 162 will then be actuated, either at the same time, or one after the other, as desired, to deposit the B finishing chamber on the work table and the A′ finishing chamber in the cup-shaped holder at the zero or null-point. While these operations are going on, the rotatable base support will continue to rotate, so that the finishing units will continue to gyrate, except the one which is at the zero or null-point and, at the same time, the finishing units will continue to rotate about their own axes. The complementary grasping ring 196, being symmetrical about the axis, can continue to rotate in the grasping hooks until it is lifted high enough to disengage the complementary detents 138 and 140. The space between the complementary grasping ring 196 and the outwardly-flared portion 54** of the cup-shaped holders need be just sufficient to permit the grasping hooks to grasp the complementary grasping ring.

The control panel 206, besides being programmed to index the bridge support 142 through 180 degrees, is also programmed to index the Servo motor 86 to rotate the spiders through 45 degrees at a time. Thus, by pushing the proper control button on the control panel, the bridge support will be actuated through 180 degrees and the spiders will be actuated through 45 degrees. Control buttons are provided, also, for stopping and starting the prime mover 24 and the motor 90 and to actuate the hydraulic cylinders 162 and 170.

It will be observed in connection with FIG. 1, particularly that, as the spiders are indexed to successive 45 degrees, the finishing units will be transported through a series of orbits. Thus, the finishing unit F will orbit in the outermost orbit N, the finishing units G and E are orbiting in the next outermost orbit M, the finishing units D and H, in orbit L, and finishing units C and J in orbit K. Thus, even without actuating the bridge support means to remove a finishing chamber which is at the zero or null-point, it is sometimes desirable to actuate the Servo motor 86 just to transfer connected finishing units from one oribt to another.

Figure 4:
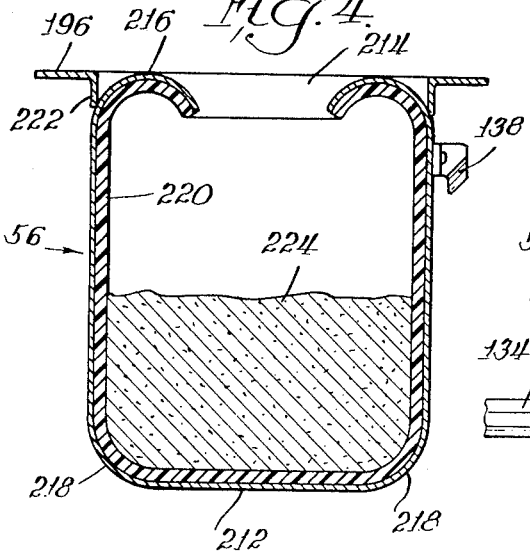
FIG. 4 is a cross-section of a finishing chamber of the invention.

FIG. 4 shows a finishing chamber of the invention suitable for use in the finishing apparatus just described. This finishing chamber, designated 56, has a cylindrical wall 210, a flat bottom 212, and a restricted opening 214 at the top.

The restricted opening 214 is formed to arc inwardly, as shown at 216, on a radius about one-eighth of the diameter of the cylindrical wall 210, plus or minus about 10 or 15 percent, and through an arc of between about 135 degrees and about 180 degrees. The cylindrical side wall 210 is connected to the flat bottom 212, arcuate portions 218, and the hole is constructed by drawing a single sheet or by folding suitably drawn portions into a unitary opening. The finishing chamber 56 is lined with a cushioning lining 220, in accordance with the customary practice in the art.

At the top of the finishing chamber 56, there is provided a flat annular complementary grasping ring 196 having a depending cylindrical flange 222 at its inner circumference, which flange 222 is welded, or otherwise secured, to the side wall 210 at a point, advantageously, where the flange 222 is, in effect, an extension of the cylindrical side wall 210.

In FIG. 5, there is shown a finishing unit, corresponding to the right hand one in FIG. 3, which shows the position assumed by the finishing material 224 and the work piece 226, when the finishing unit is being rotated about its axis. The arcuate portion 216, connecting the cylindrical side 210 and the restricted opening 214, extends inwardly a distance sufficient to keep the finishing material from spewing out of the restricted opening 214. The amount of finishing material 224 placed in the finishing chamber is adjusted to this end, so that none of the finishing material will spew out as a result of the combined rotary and gyratory motions.

The work piece 226, because of the combined rotary and gyratory motions impressed on the finishing material 224, will be continually scrubbed by the finishing material and finished according to the particular character and properties of the finishing material.

Thus, in FIGS. 1 through 9, there is illustrated a gyratory finishing machine in accordance with the invention in which the finishing units are caused to gyrate in a common gyratory plane, and simultaneously therewith, to rotate about their axes, and in which selected finishing units are brought to a null-point, there grasped and removed, and carried to a loading station, and a newly charged finishing chamber carried back to the empty holding means at the null-point, and the operation repeated with a different selected finishing chamber.

Figure 10:
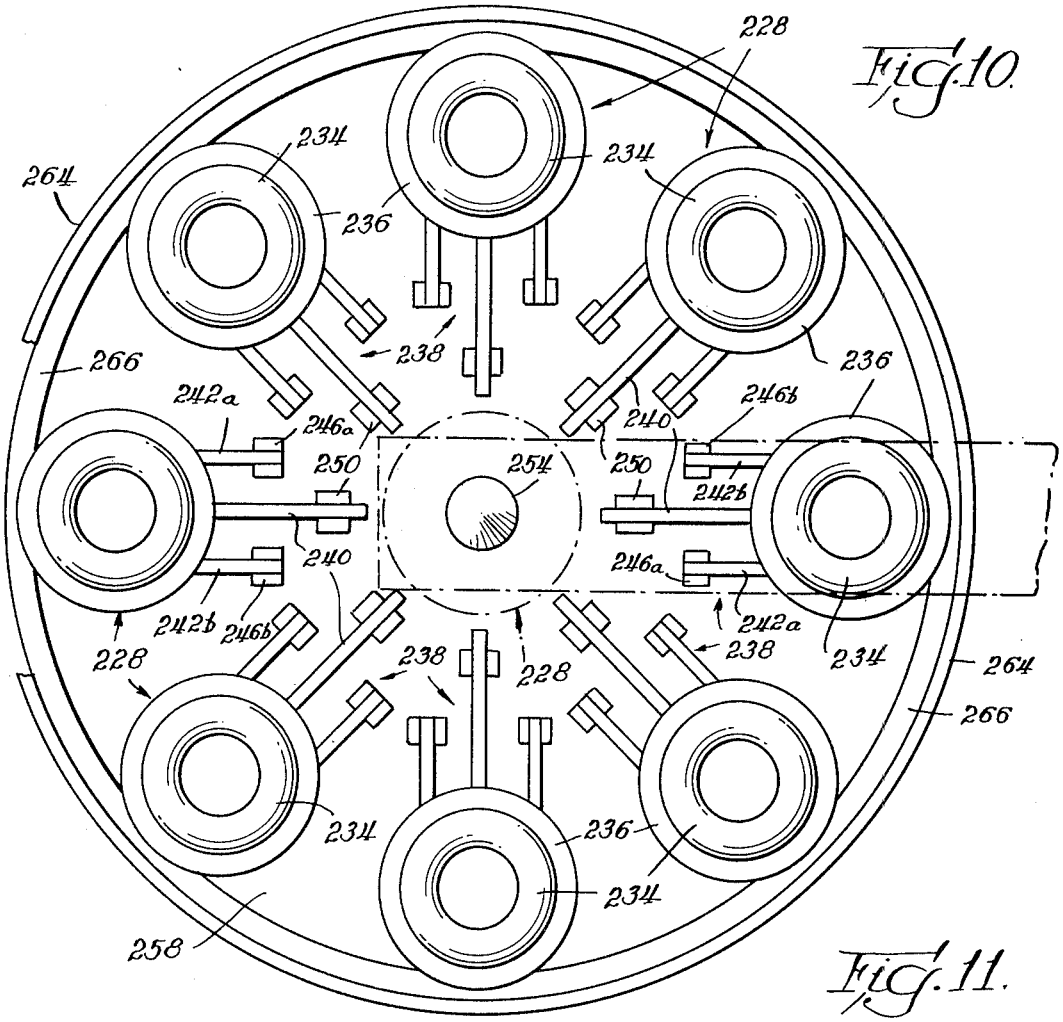
FIG. 10 is a plan view of another modification of the invention.
Figure 11:
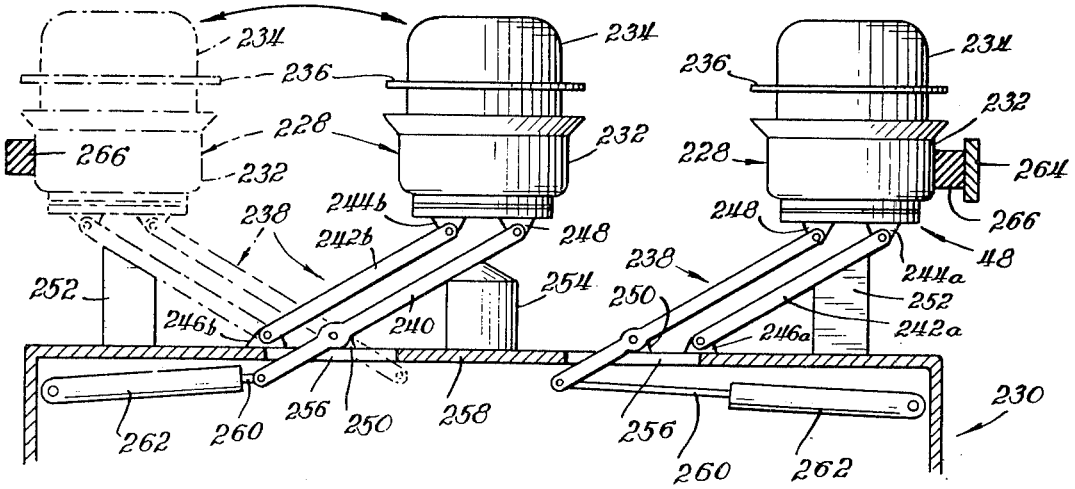
FIG. 11 is a side elevation in partial section of FIG. 10.

In FIGS. 10 and 11, there is shown another form of the invention in which a plurality of finishing units 228 are mounted about the periphery of a rotatable base support 230, which is mounted for rotation in essentially the same manner as the rotatable base support 10 of FIGS. 1 and 2. The rotatable base support 230, however, is hollow, to accommodate apparatus for moving the finishing units, as will be described.

Each of the finishing units 228 comprises a cup-shaped holder 232 and a finishing chamber 234, constructed in essentially the same manner as the cup-shaped holders and finishing chambers of FIGS. 1 and 2, except that the cup-shaped holder 232 is not quite so deep and the complementary grasping ring is attached directly to the side wall of the finishing chamber 234 at a point intermediate the top thereof and the top of the cup-shaped holder 232.

The bottom of the cup-shaped holder 232 is affixed to the upper surface of a flat bearing race 48, the bottom face of which is affixed to the tripod linkage 238, having three parallel links, 240, 242*a*, and 242*b*. The links 242*a* and 242*b* are pivoted to lugs 244*a* and 244*b* and lugs 246*a* and 246*b*, and the links 240 are pivoted to lugs 248 and 250. The lugs and the links are arranged to form a parallelogram, so that the finishing unit 228 can be moved from the central position, shown in FIG. 11, to the peripheral position, shown by the dotted lines. A plurality of peripheral posts 252 are provided to support the finishing units 228 in their peripheral positions and a single central post 254 is provided to support the finishing unit 228 in the central or null-point position.

The links 240 extend through apertures 256 in the top wall 258 of the rotatable base support 230 and are connected to the pistons 260 of the hydraulic cylinders 262. Thus, when the piston 260 is drawn into the hydraulic cylinder 262, it will cause the finishing unit 228 to be transported from the position shown in dotted lines to the central or null-point position.

Once the finishing unit is transported to the null-point position, the finishing chamber thereof can be grasped by the grasping means and carried to a loading station by apparatus the same as described in connection with FIGS. 1 and 2.

A rigidly supported peripheral support 264 forms a girdle about the peripherally-disposed finishing units 228. On the inner surface of the support 264 is a resilient friction material, such as rubber, or the like, positioned so that, when finishing units 228 are at rest on the peripheral post 252, they have their outer cylindrical walls in contact therewith. Thus, when the rotatable base support 230 is rotated, the friction between the cup-shaped holder 232 and the resilient friction material 266 will cause the cup-shaped holders to rotate about their axes.

If desired, complementary detents 138 and 140 can be provided for the cup-shaped holder 232 and the finishing chamber 234, as shown in FIGS. 4, 5, 8, and 9.

Figure 12:
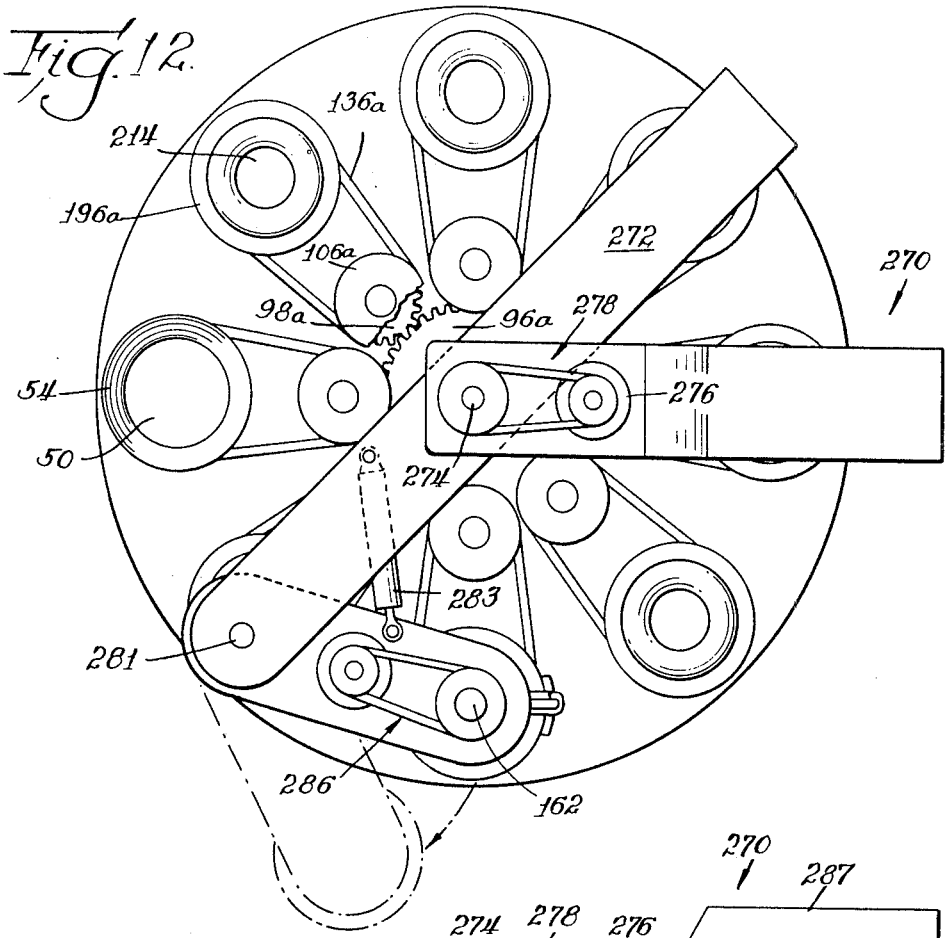
FIG. 12 is a plan view of another form of the invention.
Figure 13:
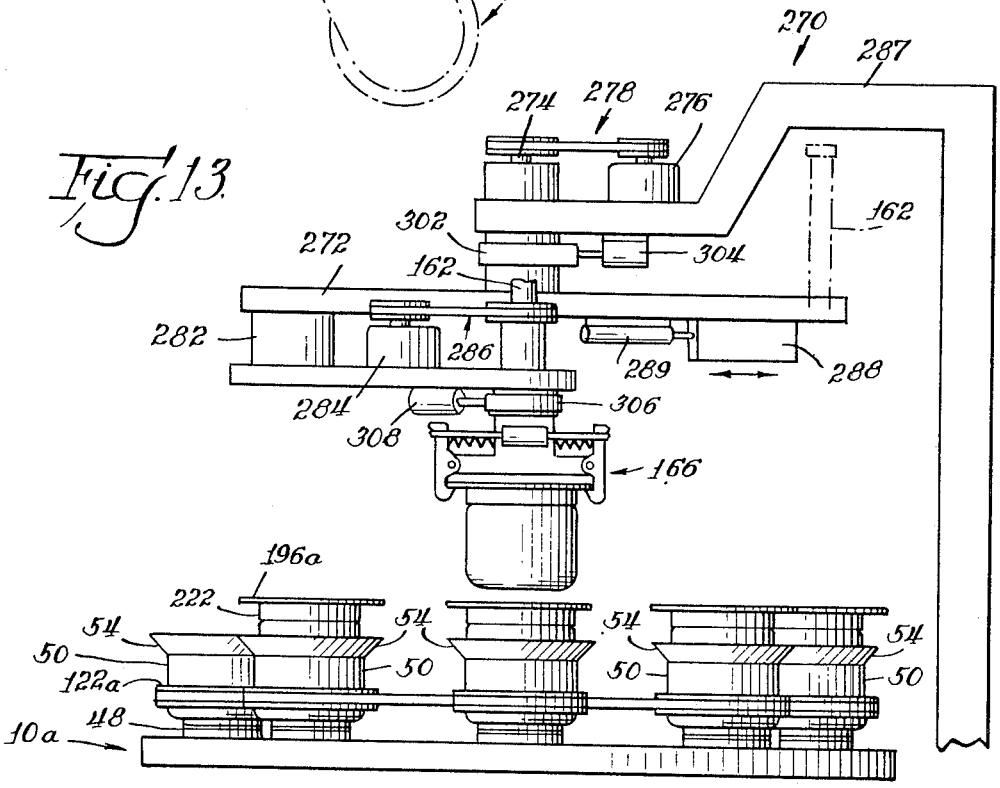
FIG. 13 is a side elevation of FIG. 12.

In FIGS. 12 and 13, there is shown another modification of the invention. In this modification, the flat bearings 48*a* are mounted directly on the top surface of a rotatable base support 10*a*, which is supported and driven the same way that the rotatable base support 10 of FIGS. 1 and 2 is supported and rotated. No provision is made in this modification for moving the finishing units to the center null-point. In this modification, the null-point relation is established by causing the grasping and removing means to gyrate in unison with the gyration of the finishing units.

To this end, there is provided a suitable rigid support 268, having an arm 270 extending out over to the axis of the rotatable base support 10. The arm 270 supports a rotatable arm 272 supported by the axial shaft 274, which is driven by the motor 276 through the belt and pulley linkage 278. The motor 276 is a variable-speed motor, so that the speed can be accelerated to the point where the rotatable arm 272 rotates in synchronism with the rotatable base support, or slowed down.

The rotatable arm 272 has an arm 280 pivoted thereto at 281 and supported thereon by bearing washer 282. At the end of arm 280, there is mounted a grasping means 166 and hydraulic cylinder 162 adapted to function in the same manner as described with respect to FIGS. 1 and 2.

The arm 280 is provided with hydraulic cylinder 283 adapted to move the arm from the solid-line position, shown in FIG. 12, to the dotted-line position. In the solid-line position, the axis of the grasping and lifting means 166 coincides with the axis of a finishing chamber when the motor 276 has brought the grasping and removing means 166 into synchronism with a selected finishing unit. The grasping and removing means can then be lowered, so that the hooks 186 grasp the complementary grasping ring 196, and then raised to remove the finishing chamber from the cup-shaped holder. The arm 270 has a raised portion 287, in order to accommodate the hydraulic cylinder which will be rotating with the arm 280.

If desired, the grasping and removing means 166 and the hydraulic cylinder 162 can be mounted to rotate about its axis and to be driven by the motor 284 through the belt and pulley linkage 286. In this way, the rotation of the grasping and removing means 166 can be synchronized with the rotation of the finishing unit, so that there will be little or no friction between the hooks 184 and 186 and the complementary grasping ring 196. This same feature can also be incorporated into FIGS. 1 and 2, if desired.

The finishing units are rotated about their axes by driving gear 96*a*, driven gears 98*a*, sheaves 106*a* and 122*a*, and belts 136*a*, in the same manner as described in connection with FIGS. 6 and 7.

In the operation of the device according to FIGS. 12 and 13, the rotatable base support 10*a* is caused to rotate, thereby causing the finishing units to gyrate about a common axis or center. Concomitantly therewith, the finishing units are caused to rotate about their respective axes, so that a rotating motion is impressed upon a gyratory motion. The grasping and removing means is then caused to gyrate in unison with a selected finishing unit, and the finishing chamber therein is grasped and removed and carried to a work station where the finishing chamber is released and substituted by a newly-charged finishing chamber which is returned to the empty cup-shaped holder by reversing the process.

In order to compensate, at least in part, for the unbalance due to the weight of the arm 280, the weight of the grasping and removing means 166, and the weight of the finishing chamber and contents, a counterweight 288 can be provided. Alternatively, the arm 280 and its accouterments can be duplicated on the opposite end of the arm 270 and the diametrically opposed finishing chambers grasped and removed simultaneously. In this way, unbalance of the rotatable base support 10*a* and the rotatable arm 270 and its accouterments is compensated, at least in part.

Alternatively, the counterweight 288 can be slidably mounted on the under side of the arm 270 and a hydraulic cylinder 289 provided for moving the counterweight 288 along the arm 270 in the direction shown by the arrows. Thus, by suitable control at the loading station, the hydraulic cylinder 289 can be actuated to move the counterweight 288, as required, to bring the system into balance.

If desired, a brake 302 and a brake actuator 304, which may be a hydraulic cylinder, can be provided in order to brake the rotating arm 272 to a stop. Also, if desired, a brake 306 with brake actuator 308 can be provided for braking the rotating grasping and removing means 166 to a stop.

Figure 14:
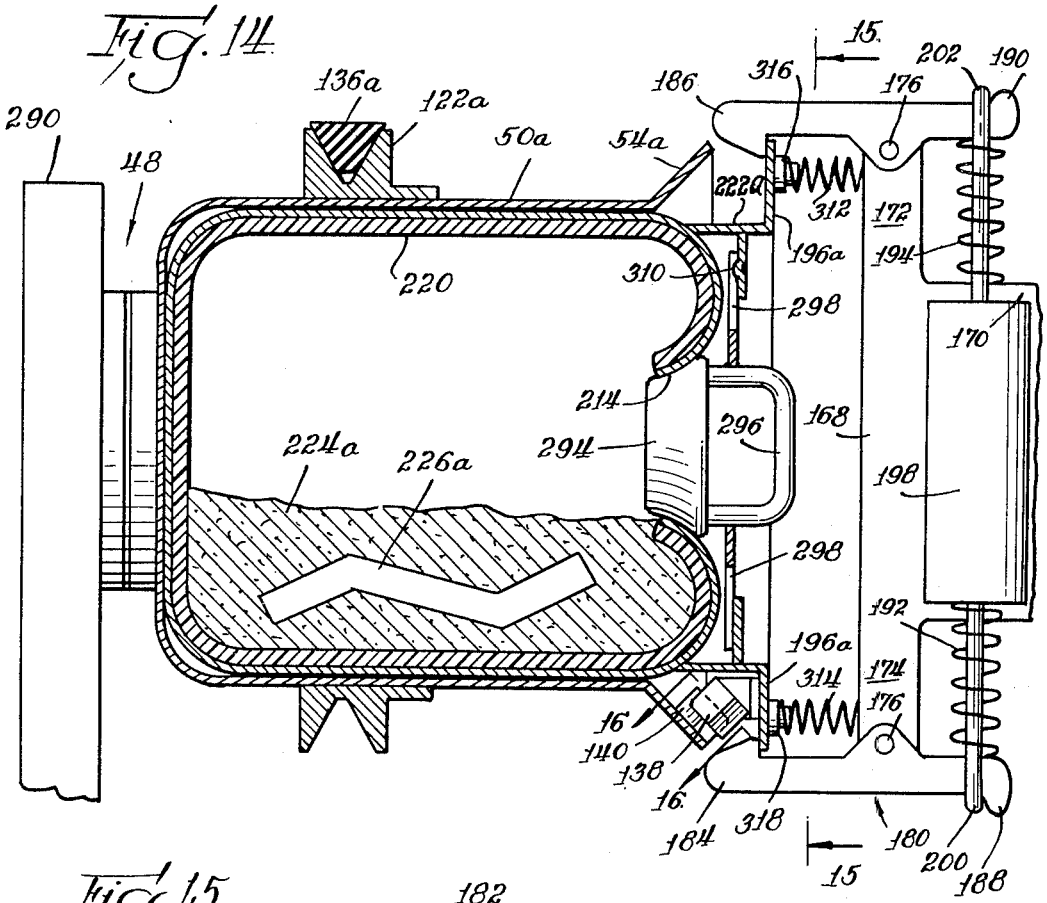
FIG. 14 is a fragmentary side elevation of another form of the invention.
Figure 15:
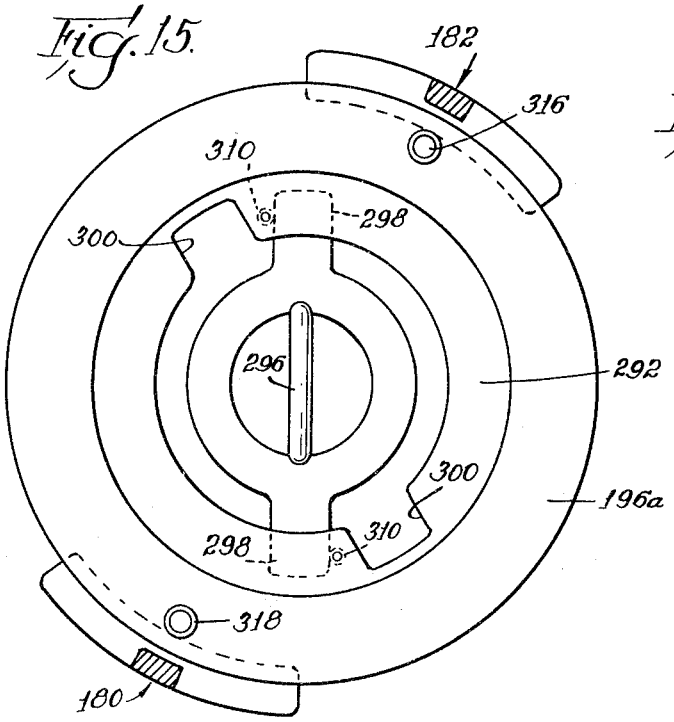
FIG. 15 is a partial face view taken along line 15—15 of FIG. 14.
Figure 16:
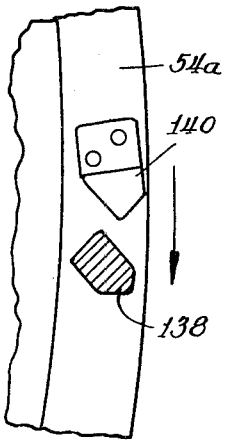
FIG. 16 is a partial section taken along line 16—16 of FIG. 14.

In FIGS. 14, 15, and 16, is shown a modified form of the finishing chambers according to the invention which are designed for use when the rotatable base support 10, 10*a*, or 230 is mounted for rotation in a vertical plane. In FIG. 14, the element 290 corresponds to one of the spiders of FIG. 1, or the rotatable base support 10*a* or 230.

In this form of the invention, the cylindrical flange 222*a* is extended, so that it is longer than the cylindrical flange 222, to beyond the top of the finishing chamber, to provide for the mounting of the annular plate 292. The annular plate 292 is affixed to the inner periphery of the flange 222*a* and is normal thereto. Also, a plug-type closure 294 is provided for the restricted opening 214. This plug is provided with a handle 296 and bayonets 298 for cooperation with the bayonet slots 300, to provide a bayonet-slot latch for locking the plug 294 in the restricted opening 214. A detent 310 may be provided, if desired, to prevent accidental unlatching of the bayonet latch.

The side wall 50*a* of the cup-shaped holder is extended up to or above the top of the finishing chamber and the complementary grasping ring 196*a* is extended out beyond the outward flange 54*a*, so that it can be easily grasped by the grasping hooks 180 and 182. In this modification, the grasping means is provided with springs 312 and 314 and spring feet 316 and 318, disposed between the arms 172 and 174 of the yoke 168. These springs are made strong enough to press the flange or ring 196*a* firmly against the hooks 184 and 186, against the weight of the finishing chamber and its contents. Alternatively, the hooks can be slotted to receive the complementary grasping ring 196*a* for the same purpose.

If desired, the bottom of the finishing chamber can be constructed of or laminated with magnetic material and magnets provided in the bottom of the cup-shaped holder, more firmly to hold the finishing chamber in the cup-shaped holder. This is of particular advantage in devices in which the gyratory plane is vertical but, if desired, can be substituted in the other modifications for the detents 138 and 140. Also, if desired, the grasping hook can be replaced with electromagnets which, when actuated, will grasp the finishing unit and, when deactivated, will release the finishing unit.

Figure 17:
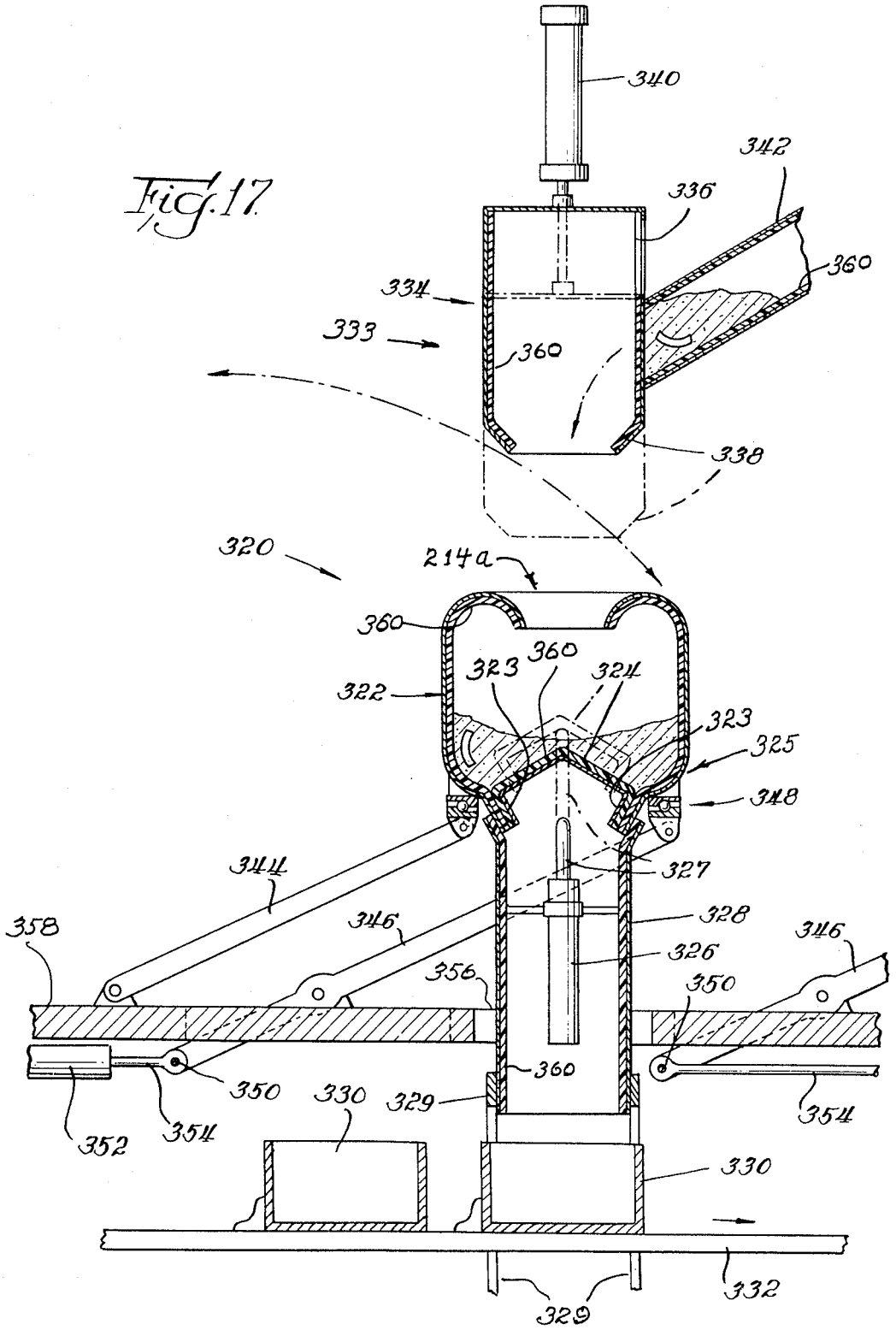
FIG. 17 is a fragmentary side elevation of a modification of FIGS. 10 and 11.

In FIG. 17 there is shown a modification of FIGS. 10 and 11, in which the essential difference is in the loading and unloading means 320, which is constructed so that the finishing chamber 322 is unloaded through the bottom by means of trap door 324 and charged through the restricted opening 214*a*. The bottom of the finishing chamber 322 is shaped, generally, as an inverted truncated cone, as shown at 325. The trap door 324 is conical shaped and has a depending flange 323 at the base thereof, which is in the shape of an inverted truncated cone having the same slope and dimensions as the inverted truncated cone portion 325 of the bottom of the finishing chamber 322.

The trap door 324 is actuated to the open position, shown in dotted lines, by hydraulic cylinder 326 and its piston rod 327. If desired, the trap door 324 may have an axial stud depending therefrom the distance shown in the dotted lines 327, with a fairly wide base, so that when the finishing chamber is swung into position in the arc, shown by the arrows and the broken line, the stud will engage the piston rod 327 and the trap door will be opened with the seating of the finishing chamber. In that case, the hydraulic cylinder 326 need not be used. It can be replaced by an axial stud.

The finishing chamber 322 seats in the top of the discharge tube 328, which top has an outward flare complementary to the slope of the inverted truncated portion 325.

The discharge tube 328 is supported by bridge 329, the legs 329*a* of which are fastened to the fixed base or frame of the machine. Receiving containers 330 carried by belt 332 are adapted to be positioned under the discharge tube 328 when the finishing chamber 322 is unloaded.

The finishing chamber 322 is supported by an annular bearing race 348, the top face of which is welded to, or otherwise affixed to, the bottom the finishing chamber 322.

The finishing chamber is moved from the center or nullpoint position, shown in FIG. 17, to the periphery of the rotatable base support 358 in essentially the same manner as in FIGS. 10 and 11. Thus, links 340 and 346 correspond to links 242 and 240 of FIGS. 10 and 11, and the hydraulic cylinder 352 and piston rod 354 correspond to the hydraulic cylinder 262 and the piston rod 260 so that, when the hydraulic cylinder 352 is actuated, the parallel linkage is actuated to swing the finishing chamber 322 in the arc shown by the broken line and arrows over to the peripheral position shown in FIG. 11. Since, however, the finishing chamber 322 is not removed, there is no need for a cup-shaped holder, as shown in FIG. 11 and, as a consequence, the finishing chamber is mounted directly on the bearing race 348. This bearing race is annular to provide a central opening through which the contents of the finishing chamber can be discharged. Also, the rotatable support 358 has a central opening 356 through which the discharge tube 328 projects upwardly to the position shown.

In this modified form, there will be two links 346, in order to provide a tripod-type parallelogram linkage whereas, in FIGS. 10 and 11, there are two links 242. The bottom ends of the links 346 are connected by a transverse rod 350, which is connected to the piston rod 354, so that actuation of the hydraulic cylinder 352 actuates both of the links 346 in order to shift the finishing chamber 322 from the peripheral position shown in dotted lines in FIG. 11 to the null-point position shown in FIG. 17.

Located axially above the discharge tube 328, and axially above the restricted opening 214*a* when the finishing chamber 322 is in the null-point position, is a loading means 333, which consists of supply chute 342 and a loading valve 334. The loading valve 334 is mounted for axial movement, with reference to the finishing chamber 322, and with reference to the loading chute 342, and is actuated from the position shown to the position shown in broken lines by the hydraulic cylinder 340. The loading valve 334 has a side aperture 336 at the top thereof, which registers with the opening in the loading chute 342 when the loading valve 334 is lowered.

In the parts to which the work piece is exposed, a cushioning lining 360 is provided. The receiving containers 330 can be made of sufficiently soft material as to avoid damage to the work pieces, or they can also be lined with a cushioning lining.

In the operation of the device according to FIG. 17, the hydraulic cylinder 352 is actuated to swing the finishing chamber 322 from the peripheral or gyrating position to the center null-point position shown. The trap door 324 is then opened and the finishing material and the work piece pass out through the annular opening formed between the trap door on the bottom of the finishing chamber down the discharge tube or chute 328 into the receiving container 330. The trap door 324 is then closed and the loading valve 334 actuated to the position shown in dotted lines, whereupon the finishing material and work piece in the loading tube 342 is released and is discharged into the finishing chamber 322 through the restricted opening 214*a* in the top thereof. To facilitate this, the bottom of the loading valve 334 tapers inwardly as shown at 338 and, if desired, the length of the loading valve 334 and of the hydraulic cylinder 340 can be increased so that, when the loading valve 334 is lowered, the inwardly-tapered bottom edges 338 will seat in the restricted opening 214*a*. It will be understood, of course, that in the uppermost position of the loading valve 334, it will be high enough to clear the finishing chamber 322 as it swings along the broken line to the peripheral position.

It is to be understood that the invention is not to be limited to the exact details of operation or structure shown and described, as obvious modifications and equivalents will be apparent to one skilled in the art.

I claim:

1. A process for finishing work pieces which comprises subjecting the work pieces to the action of a finishing material in a plurality of finishing chambers while said finishing chambers are caused to gyrate about a common center and independently thereof to rotate about individual axes, whereby the work pieces and finishing material are subjected to a rotary motion impressed upon a gyratory motion, and selectively removing a gyrating finishing chamber to a work station without stopping the gyration and rotation of the other finishing chambers.

2. A process for finishing work pieces which comprises subjecting the work pieces to the action of a finishing material in gyrating finishing chambers and selectively removing a gyrating finishing chamber to a work station without stopping the gyration of the other finishing chambers, in which the selected finishing chamber is brought to a null-point at the center of the gyration and held at the null-point independently of the gyration.

3. A process for finishing work pieces according to claim 2, in which said finishing chambers rotate independently about their axes, whereby the work piece and finishing material are subjected to a rotary motion impressed upon a gyratory motion.

4. A process for finishing work pieces according to claim 2, in which said null-point is said work station and the loading and unloading of said selected finishing chamber is effected while it is at said null-point.

5. A process for finishing work pieces according to claim 4, in which said finishing chambers gyrate in a common horizontal plane about a common center and in which, in the movement of said selected finishing chamber to said null-point, its center is always in a vertical plane which passes through said common center.

6. A process for finishing work pieces according to claim 2, in which said selected finishing chamber is carried from said null-point to a remote work station where it is unloaded and a loaded finishing chamber is carried back to said null-point and then brought into gyration with the other finishing chambers.

7. A process for finishing work pieces which comprises subjecting the work pieces to the action of a finishing material in gyrating finishing chambers and selectively removing a gyrating finishing chamber to a work station without stopping the gyration of the other finishing chambers, and which further comprises preparing a finishing chamber by placing a work piece in said finishing chamber together with finishing material, placing a plurality of finishing chambers so prepared in a corresponding number of holding means mounted to gyrate about a common center in a common gyratory plane, causing the finishing chambers thus placed to gyrate, bringing a grasping means for grasping a finishing chamber and a selected finishing chamber to a null-point relation, grasping said selected finishing chamber and removing it from said holding means while the null-point relation exists, and carrying the removed selected finishing chamber to a remote work station.

8. The process of claim 7, in which the null-point relation is established by bringing said selected finishing chamber to said common center.

9. The process of claim 7, in which the null-point relation is established by causing said grasping means to gyrate in unison with said selected finishing chamber.

10. The process of claim 7, in which each finishing chamber is caused to rotate about its axis, whereby the work piece and finishing material are subjected to a rotary motion impressed upon a gyratory motion.

11. The process of claim 7, in which the prepared finishing chambers are caused to gyrate in a plurality of orbits.

12. The process of claim 11, in which the prepared finishing chambers are caused to move from one orbit to another location.

13. The finishing process of claim 12, in which said other location is another orbit.

14. The finishing process of claim 13, in which said other location is said common center.

15. The finishing process of claim 11, in which the null-point is established by causing the selected finishing chamber to move from orbit to orbit and finally to a position over said common center.

16. The finishing process of claim 15, in which each finishing chamber is caused to rotate about its axis, whereby the workpiece and finishing material are subjected to a rotary motion impressed upon a gyratory motion.

17. The finishing process of claim 7, in which the gyratory plane is horizontal.

18. The finishing process of claim 16 in which the gyratory plane is horizontal.

19. A process for finishing work pieces which comprises causing a plurality of finishing chambers containing work pieces and finishing material to gyrate in a common gyratory plane about a common center, establishing a null-point relation between a selected finishing chamber and means for loading and unloading said chamber, which null-point is independent of and not affected by the continued gyration of said finishing chambers, whereby the loading and unloading of the chamber can be effected over an extended period without stopping the gyration of the finishing chambers other than that of the selected finishing chamber.

* * * * *

UNITED STATES PATENT AND TRADEMARK OFFICE

CERTIFICATE OF CORRECTION

PATENT NO. : 4,257,198

DATED : March 24, 1981

INVENTOR(S) : Gunther W. Balz

It is certified that error appears in the above-identified patent and that said Letters Patent are hereby corrected as shown below:

[56] References Cited, U.S. PATENT DOCUMENTS, line 6;
"4,104,831 8/1978 Kobushiki" should read
-- 4,104,831 8/1978 Kobayashi -- shown on original Letters Patent.

Col. 2, line 15; "grasp" should read -- grasp- --
Col. 4, line 11; "accordance," should read with the comma "," deleted.
Col. 5, line 61; "outwardly as" should read -- outwardly, as --
Col. 7, line 7; "line," should read -- lines, --
Col. 12, line 4; "flange" should read -- flare --
Col. 16, line 8; "claim 16 in" should read -- claim 16, in --

Signed and Sealed this

*Fifteenth* Day of *September 1981*

[SEAL]

*Attest:*

GERALD J. MOSSINGHOFF

*Attesting Officer*

*Commissioner of Patents and Trademarks*